US005288454A

United States Patent [19]

Lang et al.

[11] Patent Number: 5,288,454

[45] Date of Patent: Feb. 22, 1994

[54] METHOD OF CONTROLLING THE REMANENT INDUCTION OF A SINTERED MAGNET, AND THE PRODUCT THUS OBTAINED

[75] Inventors: Jean-Marc Lang, Meylan; Robert Tissot, Allevard, both of France

[73] Assignee: Aimants Ugimag S.A., Pierre D'Allevard, France

[21] Appl. No.: 1,249

[22] Filed: Jan. 6, 1993

[30] Foreign Application Priority Data

Jan. 23, 1992 [FR] France ..... 92 00910

[51] Int. Cl.[5] ..... B22H 3/16; H01F 1/08

[52] U.S. Cl. ..... 419/38; 419/39; 419/44; 419/53; 419/54; 148/103; 148/513

[58] Field of Search ..... 75/214; 148/101, 102, 148/103, 104, 302; 264/23; 419/28, 30, 38, 39

[56] References Cited

U.S. PATENT DOCUMENTS

| | | | |
|---|---|---|---|
| 3,530,551 | 9/1970 | Haes et al. | 25/11 |
| 4,734,253 | 3/1988 | Sato et al. | 419/30 |
| 4,793,874 | 12/1988 | Mizoguchi et al. | 148/103 |
| 4,990,306 | 2/1991 | Ohashi | 419/28 |
| 5,015,306 | 5/1992 | Ghandehari | 148/103 |
| 5,057,165 | 10/1991 | Nagata et al. | 148/102 |
| 5,080,731 | 1/1992 | Tabaru et al. | 148/103 |
| 5,178,691 | 1/1993 | Yamashita et al. | 148/101 |
| 5,201,963 | 4/1993 | Mukai et al. | 148/104 |

OTHER PUBLICATIONS

Patent Abstracts of Japan, vol. 13, No. 14 (M-784) Jan. 13, 1989 JP-63/227701, Sep. 22, 1988.

Chemical Abstracts, vol. 89, No. 2, Jul. 1978, No. 15869b, Sasaki et al. p. 640, col. 2.

*Primary Examiner*—Donald P. Walsh

*Assistant Examiner*—John N. Greaves

*Attorney, Agent, or Firm*—Dennison, Meserole, Pollack & Scheiner

[57] ABSTRACT

A method for controlling the remanance of a sintered magnet by varying the time when the orienting field is applied during cold compression. The method comprises obtaining powders of an appropriate particle size, compressing the powders in an oriented field, sintering, heat treating, machining and magnetizing to technical saturation. The cold compressing in an orienting field takes place at a precompression rate of more than 15% before the orienting field is applied. The method applies to magnets of all shapes which must have magnetic induction well defined in modulus and in direction, particularly annular magnets for traveling wave tubes.

11 Claims, 2 Drawing Sheets

METHOD OF CONTROLLING THE REMANENT INDUCTION OF A SINTERED MAGNET, AND THE PRODUCT THUS OBTAINED

The invention relates to a method of controlling the remanence of a sintered magnet by varying the time when the orienting field is applied during cold compression.

The manufacture of sintered magnets of the Sm Co or Fe Nd B or ferrite type by powder metallurgy is known basically to comprise grinding the powders to an appropriate particle size, compressing them cold in an orienting field (anisotropic magnets), sintering the "green" compacts thus obtained and heat treating, machining and magnetising them.

Now a certain number of applications require magnets where the remanence value (a) is lower than normal values, for values of up to 50% of the normal, and (b) is very precise and reproducible, in module and in direction, from one batch to another and even from one magnet to another.

These directions are chiefly either the normal to the surface of the magnet or, when the magnet has circular symmetry, the axis thereof. It is then desirable for the tangential component parallel with the surface of the magnet (or the radial component) of the induction to be less than 1% and preferably 0.1% of the normal (or axial) component.

Various prior art methods have been used in an attempt to achieve these objectives, but they have all encountered various difficulties, for example in the manufacture of annular magnets where the field has to be perfectly defined and axially oriented, like those used for producing "travelling waves tubes" (TWT).

A first possibility is to rely on the alignment of the particles in the material and to reduce the strength of the orienting field during the compression stage prior to sintering. Experience shows that this process is very difficult to control and leads to excessive dispersion of remanent induction between magnets in the same batch. The orientation gradients of the field are highly dependent on the value of the actual field and the conditions under which the cavity is filled.

A second method comprises modifying the composition of the material forming the magnets where the magnetisation has to be reduced. It is an application of experiments carried out by M G BENZ, R P Laforce and D L Martin (AIP conf. proceedings no. 18 1973). In a material of the Sm Co5 type, for example, a heavy rare earth such as gadolinium is substituted for part of the samarium; according to the substitution rate grades are obtained where there is less specific magnetisation at saturation. Rings made with these materials only require slight demagnetisation in order to adjust their axial field accurately. This process has various disadvantages:

mixed grades are difficult to produce the process is not easy to manage from the industrial point of view, since it requires a production line for each particular grade to be produced, and there are also difficult recycling problems the thermal variation of magnetisation is not the same, according to the content of heavy rare earth, so that a TWT which has a suitable magnetic profile at room temperature will become unbalanced at the operating temperature.

A third method comprises partially demagnetising the material by the action of an appropriate reverse field, such that magnetisation is brought to the residual level required for the final magnetisation. This method has three main drawbacks:

it requires strong reverse fields owing to the form of the J(H) cycle in the second quadrant, slight variations in the field cause wide variations in magnetisation; adjustment is therefore tricky, especially when far from the "bend" in the curve, i.e. in cases of strong demagnetisation even slightly heterogeneous coercivity in a ring, for example, may lead to an undermagnetised state characterised by a distribution of magnetisation with no symmetry of revolution. In that case magnetisation at the center of the ring is not directed exactly along the axis; it has a radial component. If the value of the radial component is more than about 1% of the axial component the TWT will not operate correctly.

there is sometimes excessive dispersion of magnetic properties within one and the same production batch, and unitary control of the rings is then necessary, using costly equipment.

It should be remembered that in the conventional process the orienting field is applied as soon as the cavity containing the powder to be compressed is closed, and before the powder undergoes any appreciable compression.

The method of the invention, which avoids or reduces the disadvantages of known methods, comprises carrying out cold precompression of the magnetic material occupying a cavity, at a rate (TP) of over 15% and preferably 20%, before applying the orienting field, and continuing the compression in the presence of that field until the desired maximum compression is obtained. The compression rate is the value TP(%), where:

$$TP(\%) = \frac{Vo - VTP}{Vo - VF} \times 100$$

In this formula Vo is the apparent volume of the magnetic material, VTP the apparent volume of the material at the time when the orienting field is applied, and VF the final apparent volume of the compressed material at the working pressure required for the press. The final volume is determined by preliminary compression tests.

The applied precompression rate is more particularly from 30 to 80%.

The magnetic material which occupies the cavity prior to compression is made from powders of the ferromagnetic material to be produced. It is preferable for the powder to contain a high proportion of monocrystalline grains, which is often produced by grinding to the optimum size for densification and magnetic properties.

In the procedure of the invention the magnetic material which occupies the cavity before being compressed in a magnetic field may be in the form of:

powder of the material emanating directly from grinding and filling the cavity by gravity the same powder, with its pourability into the cavity assisted by magnetic suction, comprising applying the magnetic field for a short duration the same powder, with its pourability improved at a preliminary stage by granulation in the form of small-diameter spherules, using a small quantity of binder or any other appropriate means, including rough disintegration of preagglomerated blocks in the field.

The method has been found also to be applicable, with similar results, if the final compression in a field described above is preceded by precompression without a field, followed by decompression. Decompression leaves a space which the material enters and occupies, then the material orients itself during the final compression phase in a magnetic field.

This approach is more complicated as an operating cycle, but particularly useful for making very tall items compressed in presses which only have a small filling volume, and for making special magnets with a convergent magnetic orientation.

It has further been noted that, for magnets of a given composition and with a specific production programme, a highly significant correlation may be established between the applied precompression rate and the remanence obtained after final magnetisation to technical saturation.

To obtain still more accurate induction values it is also possible, firstly to obtain an induction value (B) slightly above the desired value (Bo), for example from 103 to 115% Bo to allow for the inevitable dispersion of these values, then:

- either to apply a reverse (demagnetising) field of a controlled value, after the sintered and heat-treated magnet has been magnetised to technical saturation
- or to effect thermal demagnetisation
- or to use a combination of both methods.

It should be noted that, for magnets made by the method of the invention, demagnetisation by a reverse field requires weaker fields than those used in prior art (3rd method), and that remagnetisation during the stabilising heat treatment is also weaker.

BRIEF DESCRIPTION OF THE DRAWINGS

The invention be understood better from the following examples illustrated in FIGS. 1 and 2, in which.

It will be observed from this figure that the demagnetisation field H2 according to the invention is smaller than the prior art field H1 and requires less accuracy (magnitude ΔH2) than the prior art field (precision ΔH1).

EXAMPLE 1

Magnets with final dimensions 20×8×3 mm are prepared as follows:

An SmCo5 type alloy containing 36.3% (by weight) of Sm is ground to 4 μm Fisher particle size. It is filled into the cavity in the press by gravity and compressed at a final pressure of 3t/cm2 after various precompression rates when a field of 800 kA/m (10 kOe) is applied. The resultant compacts are sintered at 1110° C. ±5° C. under vacuum for 3 hours, tempered at 875° C. ±5° C. for 24 h, then quenched in a gas at a speed of 100° C./min. These operating values are dictated by the material and particle size used, but are not specific to the process in question. When the products have been machined and magnetised to technical saturation at 1600 to 2400 kA/m (20 to 30 kOe) the magnetic properties are measured.

Figure 1:
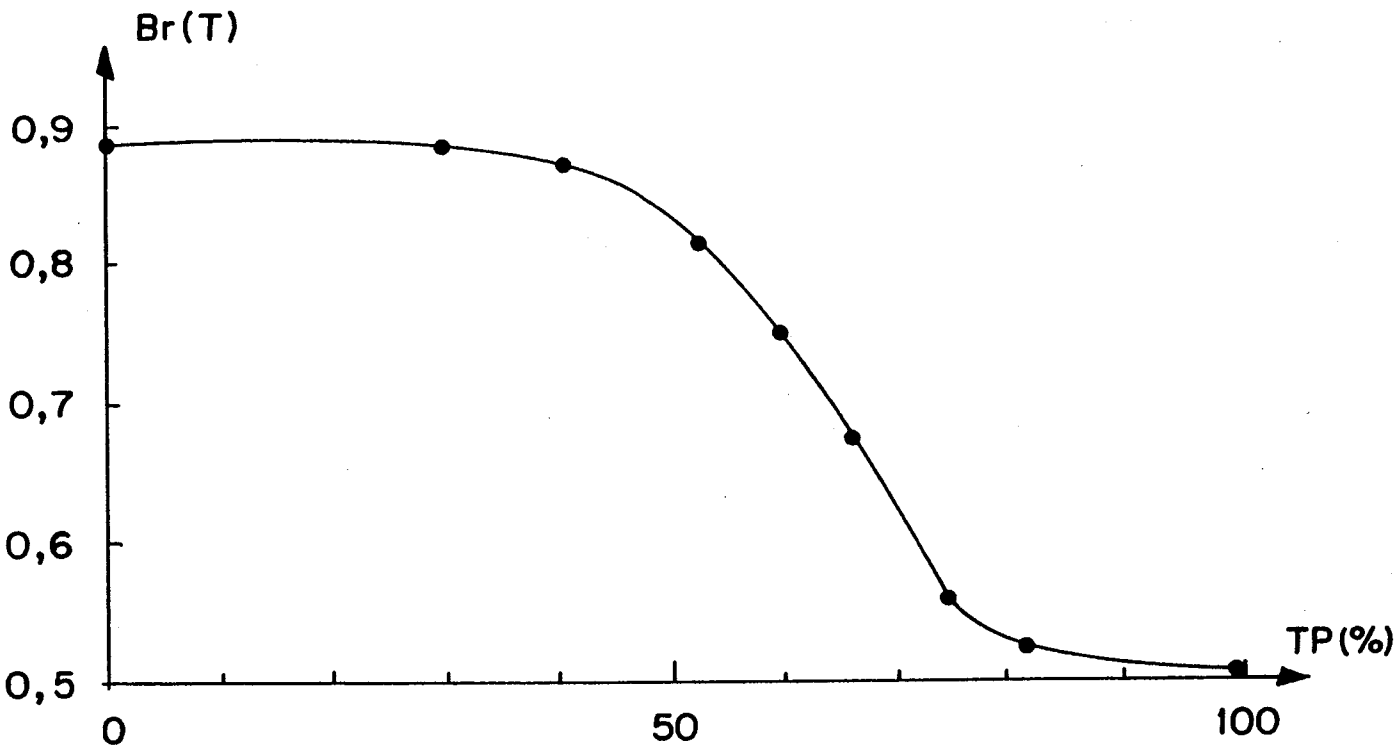
FIG. 1 is a grading curve showing the compression rate versus the remanent induction Br, for magnets prepared in accordance with Example 1 below which have received variable compression rates.

The correlation between the precompression rate and the induction obtained is given in Table I and shown graphically in FIG. 1.

EXAMPLE 2

Manufacture of annular magnets composed of Sm Co5 for TWT.

These magnets have the following final dimensions:

outside diameter: 17.8 mm
inside diameter : 9.1 mm
height : 3.75 mm and are obtained by a manufacturing method the same as that in Example 1, with a precompression rate of 68%.

They must have an axial induction peak of:

$$0.105 \pm 5 \times 10^{-3} T \ (1050 \pm 50 \ G)$$

Figure 2:
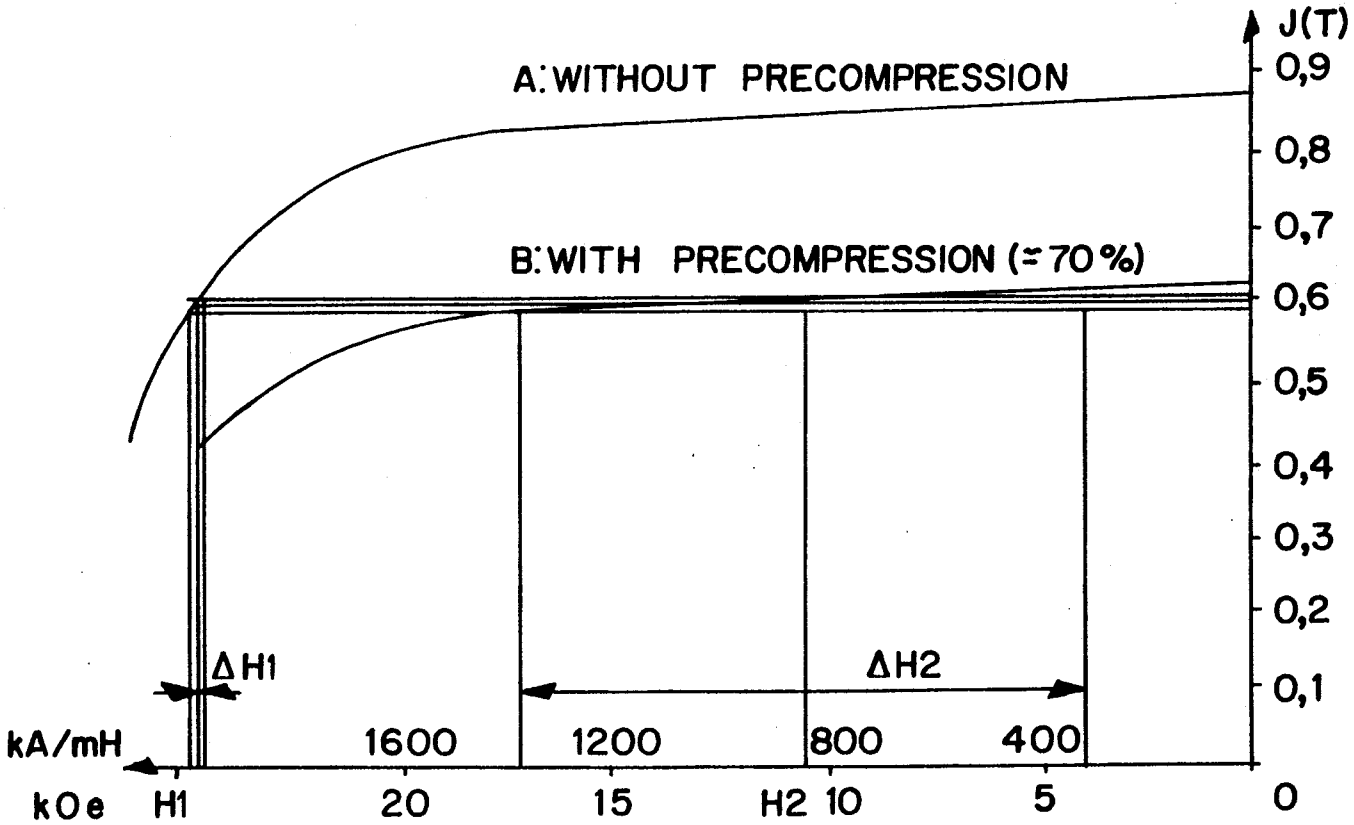
FIG. 2 is a diagram showing the demagnetisation curves of a type Sm Co5 magnet prepared as in prior art—without precompression (curve A)—and according to the invention with precompression (curve B).

In normal practice, i.e. when there is no precompression, the magnets obtained have a remanence of 0.88 T (8800 G). By applying 68% precompression one can obtain a magnet where the axial induction peak is Br=0.113 T (1130 G). Experience shows that the reverse field required to control the desired remanence (0.6 T) is of the order of 880 kA/m (11 kOe), with a relatively wide control range of ±500 kA/m (±6.2 kOe)—see curve B in FIG. 2.

In the case of a conventional Sm Co5 magnet, i.e. in the absence of precompression, before the orienting field is applied, the reverse field required is on the one hand stronger, 2000 kA/m (approx. 25 kOe). It must above all be much more accurate, ±8 kA/m (±0.1 kOe)—curve A—since this operation takes place beyond the bend in the curve J=f(H), J being the magnetic polarisation and H the field applied.

Magnets obtained according to the invention have the following advantages over prior art magnets, apart from the regularity and precision of their magnetic characteristics:

- the product is more homogeneous, given that the powder has reduced mobility and is hardly displaced by the action of the orienting field
- it has more mechanical strength during the thermal cycles, and in particular good resistance to crazing, through being less anisotropic
- when the magnetic characteristics are obtained by the action of a low-strength reverse field, the magnets obtained are less sensitive to thermal remagnetisation, particularly in the case of Sm Co5 type magnets
- in the case of magnets which have circular symmetry, the axiality of the field is respected very precisely; the radial component is less than 1% of the axial component
- the manufacturing cost is lower
- all the magnets obtained have the same temperature coefficient.

In addition, the method of the invention reduces the natural field gradients of the tools.

The magnets can be applied to any systems where magnetic characteristics, in respect of size and direction, have to be very precise and reproducible. They may have all kinds of geometric shape: parallelepipeds, cylinders, rings and the like.

TABLE NO. 1

| Precompression rate % | Br (T) | Axial peak (T) |
|---|---|---|
| 0 | 0.8845 | 0.1550 |
| 40.45 | 0.8700 | 0.1520 |
| 47.19 | 0.8530 | 0.1495 |
| 53.93 | 0.8130 | 0.1425 |
| 60.67 | 0.7560 | 0.1325 |
| 67.42 | 0.6780 | 0.1190 |
| 74.16 | 0.5600 | 0.0980 |
| 80.90 | 0.5135 | 0.0900 |
| 100.00 | 0.5040 | 0.0880 |

(each value is the average of 5 samples)

What is claimed is

1. A method of obtaining sintered magnets with accurate induction characteristics, comprising obtaining powders of appropriate particle size, at least one cold compressing of the powders in an orienting field, sintering, heat treating, machining and a final magnetizing to technical saturation, wherein the cold compressing in an orienting field takes place at a precompression rate (TP) of over 15% before the orienting field is applied.

2. The method of claim 1, wherein the precompression rate is over 20%.

3. The method of claim 1, wherein the precompression rate is from 30 to 80%.

4. The method of any of claims 1 to 3, wherein at rate TP pressure is removed, then the orienting field is applied and compression is resumed up to its final value.

5. The method of any of claims 1 to 3, additionally comprising applying a reverse field of controlled value to the magnet which has been magnetised to technical saturation.

6. The method of claim 5, wherein the precompression used leads to induction after technical saturation, ranging from 103 to 115% of the required induction.

7. A magnet obtained according to claims 1 having a the tangential (or radial) component of induction which is less than 1% of its normal (or axial) component.

8. The magnet of claim 7, wherein the tangential (or radial) component of the induction is less than 0.1% of its normal (or axial) component.

9. The magnet of claim 7 or 8, having a parallelepipedal shape.

10. The magnet of claim 7 or 8, having a cylindrical shape.

11. The magnet of claim 7 or 8, having an annular shape.

* * * * *